United States Patent [19]

Riecker

[11] 3,957,591

[45] May 18, 1976

[54] COKING OVEN

[75] Inventor: Johann G. Riecker, Breitscheid, Germany

[73] Assignee: Hartung, Kuhn & Co., Maschinenfabrik GmbH, Dusseldorf, Germany

[22] Filed: May 20, 1974

[21] Appl. No.: 471,538

[30] Foreign Application Priority Data

May 25, 1973 Germany ..... 2326825

[52] U.S. Cl. ..... 202/263; 202/269; 202/248; 110/173 R; 110/175 R; 122/498; 98/115 R; 34/242

[51] Int. Cl.[2] ..... C10B 27/04

[58] Field of Search ..... 202/263, 269, 248; 110/173 R, 175 R, 179; 122/498; 98/115 P; 34/242

[56] References Cited

UNITED STATES PATENTS

| | | | |
|---|---|---|---|
| 2,641,209 | 6/1953 | Lowe | 110/173 R |
| 3,709,794 | 1/1973 | Kinzler et al. | 202/248 |
| 3,812,797 | 5/1974 | Wieken et al. | 110/179 X |

*Primary Examiner*—James H. Tayman, Jr.
*Attorney, Agent, or Firm*—Michael J. Striker

[57] ABSTRACT

A coking oven has an upright wall formed with an opening which is normally closed by a door past which noxious gases escape at least at times. Outwardly adjacent the opening and the wall are formed one or more upright channels having open ends located below and above the level of the opening, respectively, and being so positioned that escaping noxious gases can enter into this channel or these channels. Arranged adjacent the upper open end or ends is a suction conduit provided with apertures through which the gases can be drawn from the channel or channels to be conveyed in the conduit.

4 Claims, 8 Drawing Figures

COKING OVEN

BACKGROUND OF THE INVENTION

The present invention relates generally to a coking oven, and more particularly to a coking oven construction provided with means for handling noxious gases which escape from an opening of such an oven.

Conventional coking ovens, which are usually arranged in batteries of several oven chambers, are of the horizontal-chamber type, wherein an opening closed by a door is formed in an upright side wall of the oven. These doors must be removable to gain access to the oven, and the opening is bounded by a seat on which the door is intended to be seated so tightly that no noxious gases can escape. It is well known that the gases which escape, particularly during the filling of the oven with additional combustible material and during the first third of the coking cycle, frequently contain carcinogenic substances and theoretically should not be allowed to be admitted into the atmosphere, at least not without first having undergone a scrubbing operation in which these substances are removed. Unfortunately, all of the many attempts which have been made to eliminate this major source of pollution associated with coking ovens — which is simultaneously the last one, since others of a less serious nature have been overcome already — have been without really satisfactory results. Constant cleaning of the seats on the door and the opening, constant replacement of doorframes and seats, of sealing elements on the door, and even of the door itself have not been able to eliminate the escape of such noxious gases at least at some times during the coking cycle.

SUMMARY OF THE INVENTION

Accordingly, it is the general object of the invention to provide an improved construction which will reliably prevent the admission into the atmosphere of noxious gases which escape from a coking oven.

More particularly, it is an object of the present invention to provide an improved arrangement wherein the disadvantages of the prior art are overcome, and the free escape of noxious gases into the atmosphere is prevented.

The invention is based on the realization that a fully effective mechanical arrangement for sealing the door in the opening of a coking oven, an arrangement which has a lifetime that is acceptable from an economic point of view, cannot be constructed at the present state of the art. The invention therefore accepts the fact that noxious gases will at least at times be able to escape from a coking oven past the door despite the attempts to seal the same, but provides for capturing of the escaped gases before they can be emitted into the ambient atmosphere, thus making it possible to treat these gases in whatever way is necessary — e.g. by scrubbing — to assure that they can be safely released into the atmosphere.

Based upon this general concept of the invention, and in pursuance of the above objects, one feature of the invention resides, in a coking oven having an upright wall formed with an opening which is normally closed by a door past which noxious gases escape at least at times, in an improvement which comprises first means defining with the upright wall upright channel means which is positioned adjacent the opening to receive the escaping gases, and second means which communicates with the channel means in a region upwardly spaced from the door and which is operative for aspirating the gases from the channel means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
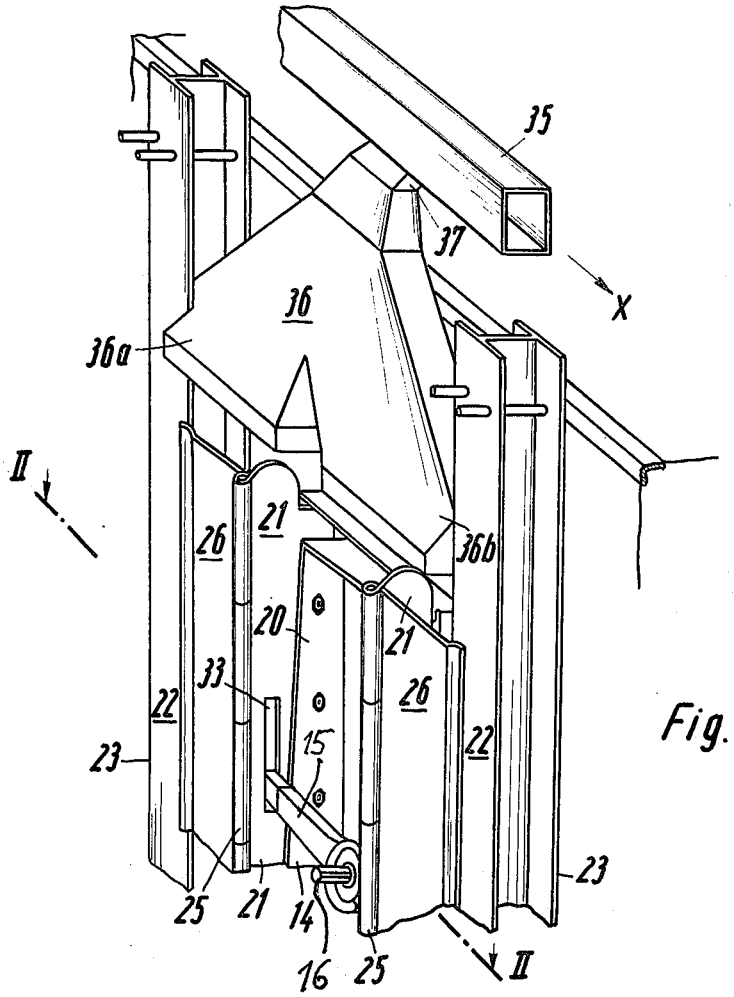
FIG. 1 is a partially broken-away fragmentary perspective view illustrating an embodiment of the invention.

Before entering into a detailed discussion of the several Figures, it is pointed out that in all embodiments like reference numerals have been employed to identify like components.

Figure 2:
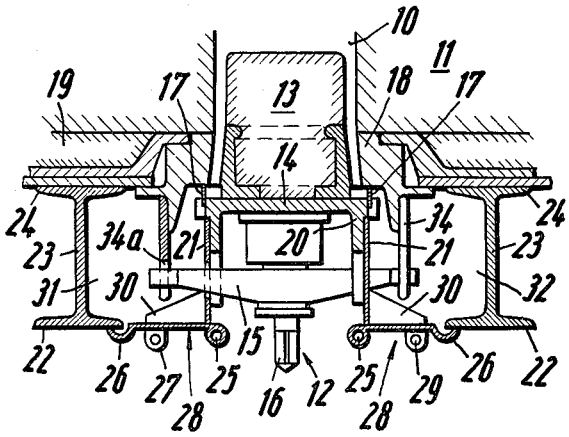
FIG. 2 is a section taken on line II—II of FIG. 1.

A first embodiment of the invention is shown in FIGS. 1 and 2 wherein reference numeral 10 generally identifies a fragmentarily and diagrammatically illustrated oven chamber 10 of a horizontal-chamber coking oven, an upright side wall of which is identified with reference numeral 19. No attempt has been made to show the coking oven or its chamber in more detail, because this is not necessary for an understanding of the invention and the construction of such coking ovens is in any case well known in the art per se.

The oven wall 19 is formed with an opening which is surrounded by a frame 18 secured to the oven wall 19. Received in this opening is a door 12 having a door frame 14 which carries a plug 13 extending through the opening part way into the oven chamber 10, and which also carries a locking arrangement which is here in form of a double-armed member 15 that is placed onto a horizontally projecting threaded bolt or rod 16. The door 12 has sealing strips 17 which engage an outwardly directed (the term outwardly refers to the direction outwardly away from the chamber 10) surface of the frame 18 and which theoretically should seal the opening accommodating the door 12 against the escape of noxious gases to the exterior of the coking oven. However, for the reasons mentioned earlier, a reliable sealing effect is not obtainable, at least not over a period of time, and in consequence the escape of noxious gases cannot be completely prevented.

The door frame 14 has outwardly extending flanges 20 on which there are mounted cover plates 21 which project above and are parallel to one another outwardly away from the oven wall 19 approximately to a plane which extends through the two outer flanges 22 of two substantially I-cross-sectioned uprights 23 the inner flanges 24 of which are in tight engagement with the wall 19. The uprights 23 are located at opposite lateral sides of the opening which communicates with the chamber 10. The outer vertical edge portions of the plates 21 have secured to them, for pivoting about vertical pivot axes or hinges 25, discrete plate portions 26 which can be moved into and out of the position illustrated in FIGS. 1 and 2 in which their own free marginal portions are in tight abutment with the outer sides of the flanges 22. The plate portions 26 are provided with cutouts through which projections 27 of latching devices 28 extend; the projections 27 are provided with the illustrated (see FIG. 2) vertically oriented openings 29 which are located at the outer sides of the plate portions 26 when the latter are in the position shown in FIGS. 1 and 2, and into which appropriate wedges or analogous elements can be driven so as to urge the plate portions 26 into tight engagement with the outer sides of the flanges 22. The devices 28, which are not visible in FIG. 1 because they are located in the portion that has been broken away in that Figure, are in form of angle plates 30 which extend horizontally and have portions 27 on them; the plates 30 are secured, e.g. by welding, to the outwardly directed sides of the plates 21.

It will be noted from FIG. 2 that the elements 14, 18, 21 and 26 thus form with the oven wall 19 respective upright channels 31 and 32 which communicate with the region where gases may escape past the door 12, so that these gases will perforce enter into these channels 31 and 32 after escaping past the sealing strips 17, between the latter and the frame 18.

The locking arrangement having the arm 15 cooperates with the plates 21 and with additional plates 34 each of which extends parallel to one of the plates 21 and is fixedly mounted on the frame 18. To make this possible, the plates 21 are formed with cutouts 33, and the plates 34 are formed with cutouts 34*a*, and each arm of the member 15 extends through one of the cutouts 33 and one of the cutouts 34*a* and can be so tightened that it will exert a force upon the door 12 which is directed inwardly of the opening in the wall 19, so as to press the sealing strips 17 against the frame 18. How the tightening is effected is of no consequence, because this is known from the art and not important for an understanding of the invention; it is done by turning member 15 on bolt 16.

The channels 31 and 32 have lower open ends and they also have upper open ends which are located upwardly spaced from the opening wherein the door 12 is accommodated. Also located on the wall 19, upwardly spaced from this opening and extending horizontally along the wall 19 (usually over the entire length of a multi-chamber coking oven battery) is a suction conduit 35 which may be connected with a non-illustrated source of suction so that suction may for instance be exerted in the direction of the arrow X in FIG. 1. In the region above each coking oven chamber 10 (only one shown) there is provided a hood 36 which is connected via a conduit portion 37 with the conduit 35 and which diverges in downward direction transversely of the opening and the door 12 to the uprights 23, and in direction outwardly from the wall 19 past the outer flanges 22 of the uprights 23. The hood 36 thus extends outwardly beyond the cross-section of the upper open ends of the channels 31 and 32. In the lower region of the hood the latter is — at least in some embodiments — separated into two sections 36a and 36b each of which has an interior cross-section corresponding to but being somewhat larger than the cross-section of the upper open ends of the respectively associated channels 31 and 32. Conduit portion 37 is preferably inclined in the direction of suction (see arrow X) as shown.

Any gases escaping past the door 12 and entering the channels 31 and 32 will be drawn upwardly out of these channels by the suction effect exerted by the conduit 35 via the hood 36 upon these gases, with the consequence that the gases will enter into the conduit 35 and will be carried along in the direction of the arrow X. The conduit 35 can be connected with a conventional scrubber known in the art, wherein the gases can be freed of their objectionable substances and can subsequently be vented to the ambient atmosphere.

Figure 3:
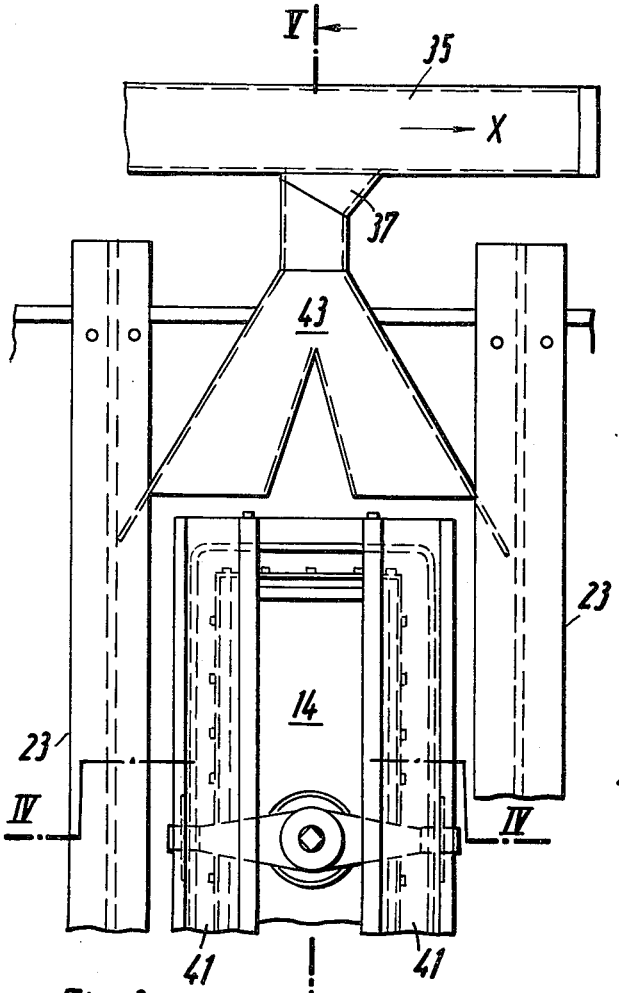
FIG. 3 is a fragmentary front-elevational view illustrating portions of a further embodiment of the invention.
Figure 5:
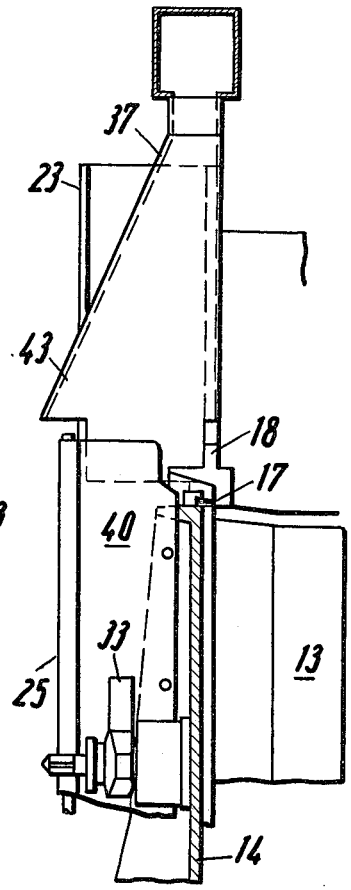
FIG. 5 is a section taken on line V—V of FIG. 3.
Figure 4:
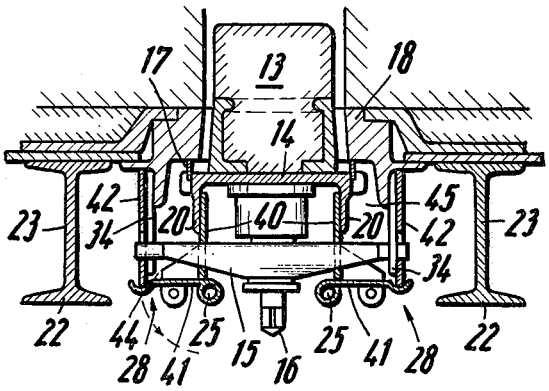
FIG. 4 is a section taken on line IV—IV of FIG. 3.

In the embodiment of FIGS. 3–5 like reference numerals identify the same component as discussed with respect to FIGS. 1 and 2, as has been pointed out previously. In this embodiment, however, the uprights 23 do not participate in forming the channels 44 and 45. Instead, plates 40 are mounted on the inner sides of the flanges 20 of the door frame 14, and carry the pivotable plate portions 41. The free ends of the plate portions 41 which latter are here narrower than in FIGS. 1 and 2, abut not the flanges 22 of the uprights 23, but instead the outer free edges of plate members 42 which are mounted on the plate members 34 that have been described already with reference to FIGS. 1 and 2. The plate members 42 have their free edges located generally in a vertical plane passing through the two pivots 25.

The hood 43 in FIGS. 3–5 is constructed analogously to the hood 36 in FIG. 1. FIG. 5 shows particularly clearly that the lower inlet cross-section of each portion of the subdivided hood 43 is substantially greater than the cross-sectional dimensions of the upper open ends of the respective channels 44, 45. In all other respects, the embodiment of FIGS. 3–5 corresponds to that of FIGS. 1–2.

Figure 6:
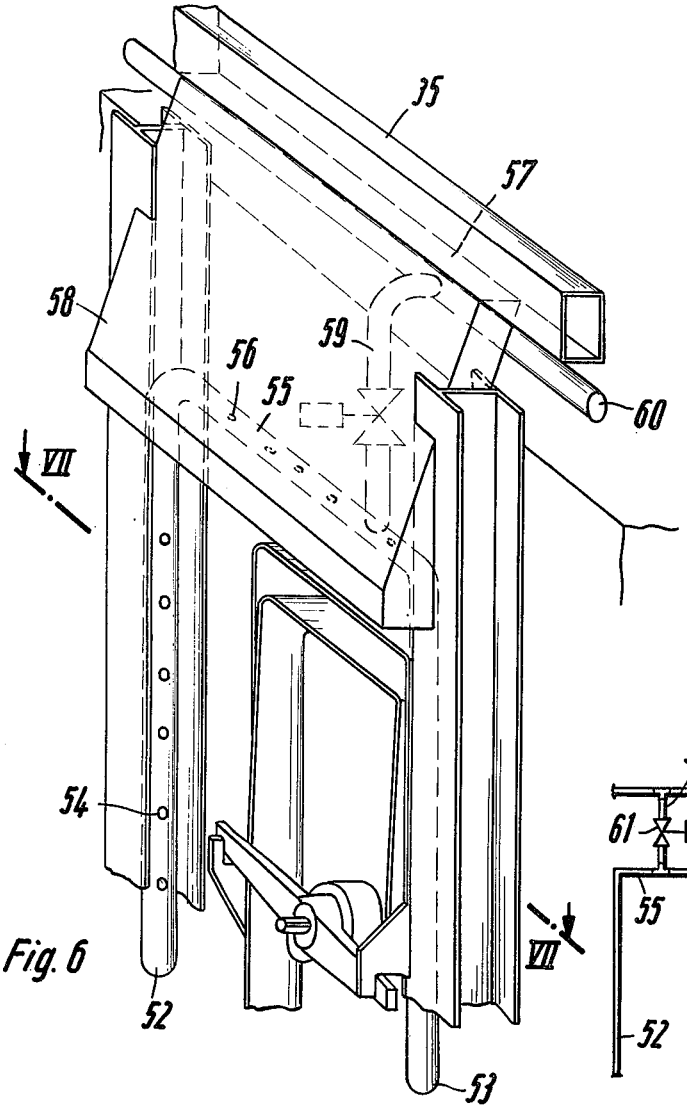
FIG. 6 is a view analogous to FIG. 1, but illustrating an additional embodiment of the invention.
Figure 8:
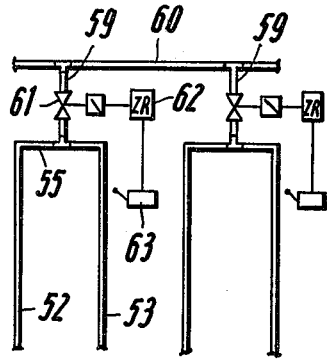
FIG. 8 is a diagram showing pressure fluid connections which may be employed in the embodiment of FIGS. 6 and 7.
Figure 7:
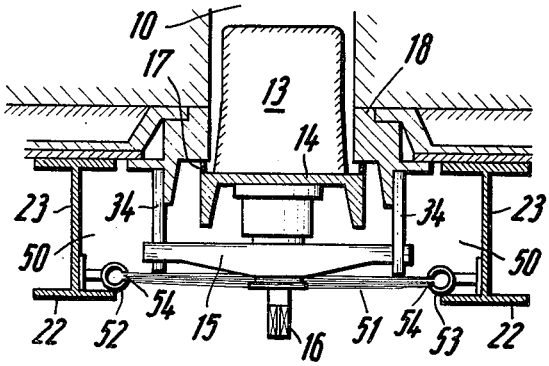
FIG. 7 is a section taken on line VII—VII of FIG. 6.

Finally, a third embodiment is illustrated by way of example in FIGS. 6–8. Again, like reference numerals are used to identify components identical with those discussed in the preceding embodiments.

In FIGS. 6–8 there exists in effect a single upright channel for noxious gas. This channel is bounded by the upright oven wall 19, the frame 18 and the uprights 23, having an open side which faces away from the door 12. This open side is in term closed by producing an air curtain 51. For this purpose upright pipes 52, 53 are mounted on the uprights 23 and have longitudinally extending slots 54 which face towards each other and from which compressed air is constantly blown transversely of the open side of the channel 50 at a location which the drawing shows (see FIG. 7) is outwardly spaced from the frame 14 of the door 12. The pipes 52, 53 have upper open ends located upwardly of the opening in which the door 12 is received and being connected by a substantially horizontal pipe portion 55 which communicates with them and which has upwardly directed air outlet openings 56 which face towards an inlet slot or the like (diagrammatically indicated by reference numeral 57 in FIG. 6) that is formed in the conduit 35. It is clear that the air curtain resulting from the air blown out of the slots 54 prevents the escape of noxious gases outwardly of the channel 50, and that the air emitted from the opening 56 of the pipe portion 55 serves to direct the upwardly rising noxious gases to the inlet slot 57, through which they are then aspirated by the suction in the conduit 35. While a hood 58 has been shown in FIG. 6, it should be understood that this is merely an advantageous possibility but is not absolutely necessary because the air streams are ejected through the openings 56 (which should be understood to be inclined inwardly towards the wall 19, in the same manner as the outer surface of the hood is inclined) serves to direct the gases towards the inlet slot 57.

In FIG. 8 I have illustrated diagrammatically how the pipes 52, 53 and 55 can be connected with a supply conduit 60 via a connecting conduit 59; the conduit 60 will, of course, be connected with a source of compressed air which is known per se. A magnet valve 61, for instance of the solenoid-operated type, may be interposed in the connecting conduit 59 to open or close the same for passage of air from the conduit 60. The valve 61 in turn is connected with a timing relay 62 of one of the commercially available types, and the latter is connected with a switch 63, for instance a limit switch, which may either be manually operated to open and close the valve 59, or which may be operated in dependence upon the positioning of a servicing machine that can in conventional manner move along the coking oven battery and service successive ones of the chambers.

All embodiments described herein have in common that they use the natural chimney effect of the channels which are provided, due to the fact that these channels are open both at the lower ends and at the upper ends. In all embodiments noxious gases which escape past the door seals must necessarily enter into the respective channels and will flow upwardly therein to be drawn by suction into the conduit 35. In no case will the arrangement according to the present invention interfere with the conventionally used servicing machines that are employed for removal and re-installation of the door 12, or with the cleaning of the frames 14, 18. At least in the embodiments of FIGS. 1–5 the conventional servicing machines can be employed, that is the machines which remove doors, clean the frames 14, 18 and reinstall the doors. The plate portions 26 of FIGS. 1–2, and 41 of FIGS. 3–5, can be constructed as control doors over at least part of their height, to permit a control (i.e. inspection) as to whether or not at any time — especially during filling and if the door seals are defective — the escaping gas might have become ignited, so that the flames would require to be put out in order to prevent permanent damage.

As far as the embodiment of FIGS. 6–8 is concerned, it will be appreciated that the air curtain 51 is so directed that under no circumstances will there be a flow component away from the wall 19, so that none of the gases in the channel 50 can escape. Since as a general rule the pressure in each coking oven chamber 10 decreases — usually continuously — throughout the coking cycle, the air curtain 51 may be switched off (after elapse of a time from the initiation of the cycle which may vary from chamber to chamber or even from battery to battery and which is controlled by the setting of the timing relay 62 — since with decreasing pressure the emission of noxious gases also decreases or even ceases. This makes it possible to significantly reduce the amount of compressed air that is required. The timing can be effected in that the switch 63 of FIG. 8 is so located that it will be tripped when one of the servicing machines moves opposite the door 12, or moves away from the door 12 after having serviced the same, at which time the relay 62 will begin to time a preset interval corresponding to the time period required (and empirically determined) for the pressure in a particular oven chamber 10 to decrease to the point where no further gas emissions will take place. When this time period has elapsed, the relay 62 will close the valve 61 and prevent further flow of compressed air into the pipes 51, 52 and 55.

Where a hood is utilized, such as the hood 36 of FIGS. 1–2 or the hood 43 of FIGS. 3–5, it is advantageous if the portions which are inclined upwardly and inwardly towards the wall 19 are arranged with spacing above the open ends of the respective gas flow channels, whereas the hood portions extending transversely to the elongation of the wall 19 — i.e. which extend out from this wall — include with one another an acute angle and extend to below the height of the upper edge of the frame 18 at least to the transversely spaced lateral edges thereof.

It will be understood that each of the elements described above, or two or more together, may also find a useful application in other types of constructions differing from the types described above.

While the invention has been illustrated and described as embodied in a coking oven, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

1. In an arrangement for removing gas emerging through the vertical and horizontal cracks bounding a closed coke oven door, in combination, a pair of vertical channels each extending along a respective one of the vertical cracks and each comprised of a first, a second and a third wall, the first wall being permanently secured to the door for movement with the door and being located to one side of the respective crack, the second wall being permanently secured to the front wall of the oven and located to the other side of the respective crack, whereby gas emerging from a vertical crack immediately finds itself intermediate the first and second walls of the associated channel, the third wall being pivotally connected to the first wall and swingable into a position in which the third wall presses against the second wall so as to complete the respective channel; means for holding each third wall in such position; a hood structure extending over the upper end of the coke oven door for capturing gas escaping from the upper horizontal crack; and means for sucking gas from the channels and from the hood.

2. In an arrangement as defined in claim 1, wherein the door is provided with locking means for holding the door in place, and wherein the first walls are provided with cutouts adapted to receive portions of the locking means.

3. In an arrangement as defined in claim 1, wherein each second wall is constituted by an I-beam having one flange abutting against and permanently secured to the front wall of the oven.

4. In an arrangement as defined in claim 1, wherein each second wall is constituted by a plate member.

* * * * *